US012291376B2

(12) United States Patent
Krautkrämer

(10) Patent No.: US 12,291,376 B2
(45) Date of Patent: May 6, 2025

(54) CLOSURE CAP AND CONTAINER NECK FOR PREVENTING DETACHMENT OF A TAMPEREVIDENT STRIP

(71) Applicant: BERICAP HOLDING GMBH, Budenheim (DE)

(72) Inventor: Günter Krautkrämer, Budenheim (DE)

(73) Assignee: BERICAP HOLDING GMBH, Budenheim (DE)

( * ) Notice: Subject to any disclaimer, the term of this patent is extended or adjusted under 35 U.S.C. 154(b) by 65 days.

(21) Appl. No.: 18/250,455

(22) PCT Filed: Nov. 12, 2021

(86) PCT No.: PCT/EP2021/081582
§ 371 (c)(1),
(2) Date: Apr. 25, 2023

(87) PCT Pub. No.: WO2022/106321
PCT Pub. Date: May 27, 2022

(65) Prior Publication Data

US 2023/0399149 A1 Dec. 14, 2023

(30) Foreign Application Priority Data

Nov. 17, 2020 (DE) ..... 10 2020 130 311.4

(51) Int. Cl.
*B65D 41/34* (2006.01)
*B65D 1/02* (2006.01)

(52) U.S. Cl.
CPC ..... *B65D 41/3409* (2013.01); *B65D 1/0246* (2013.01); *B65D 2401/15* (2020.05)

(58) Field of Classification Search
CPC ..... B65D 41/3409; B65D 1/0246; B65D 2401/15
See application file for complete search history.

(56) References Cited

U.S. PATENT DOCUMENTS

| | | | |
|---|---|---|---|
| 5,285,912 A | 2/1994 | Molinaro | |
| 2012/0031871 A1 | 2/2012 | Molinaro et al. | |
| 2021/0024258 A1* | 1/2021 | Krautkramer | B65D 41/3409 |

FOREIGN PATENT DOCUMENTS

| | | |
|---|---|---|
| DE | 202007009673 U1 | 10/2007 |
| DE | 102007005594 A1 | 8/2008 |

(Continued)

OTHER PUBLICATIONS

International Search Report (English Translation included) and Written Opinion issued on Feb. 24, 2022, in corresponding International Application No. PCT/EP2021/081582, 17 pages.

(Continued)

*Primary Examiner* — Shawn M Braden
(74) *Attorney, Agent, or Firm* — Maier & Maier, PLLC

(57) ABSTRACT

A closure cap having a lid portion and a cap skirt. The cap skirt includes an inner thread and defines a closure axis such that the closure cap can be screwed onto an outer thread of a container neck. A circumferential security band is arranged on an edge of the cap skirt facing away from the lid portion and connected to the cap skirt via multiple tearable bridges. At least one latching element is arranged on the inner side of the security band, and the latching element extends inwardly from the security band, wherein the latching element includes a first stop surface having a surface normal arranged at least proportionally tangentially to the cap skirt.

14 Claims, 2 Drawing Sheets

(56) References Cited

FOREIGN PATENT DOCUMENTS

| | | | |
|---|---|---|---|
| DE | 602005003562 | T2 | 11/2008 |
| WO | 2006090137 | A1 | 8/2006 |

OTHER PUBLICATIONS

Search Report issued on Mar. 31, 2021, in corresponding Germany Application No. 102020130311.4, 5 pages.
International Preliminary Report on Patentability issued on May 16, 2023, in corresponding International Application No. PCT/EP2021/081582, 15 pages.

* cited by examiner

CLOSURE CAP AND CONTAINER NECK FOR PREVENTING DETACHMENT OF A TAMPEREVIDENT STRIP

FIELD

The present invention relates to a closure cap having a lid portion and a cap skirt, wherein the cap skirt comprises an inner thread and defines a closure axis such that the closure cap can be screwed onto an outer thread of a container neck, wherein a circumferential security band is arranged on an edge of the cap skirt facing away from the lid portion and connected to the cap skirt via multiple tearable bridges, wherein at least one latching element is arranged on the inner side of the security band, wherein the latching element extends inwardly from the security band, wherein the latching element comprises a first stop surface having a surface normal arranged at least proportionally tangentially to the cap skirt, such that, in an assembled state of the closure cap and a container comprising the container neck, the first stop surface can be brought into engagement with a first stop surface of the container neck, wherein, by the engagement of the two first stop surfaces, a holding torque acting counter to an opening direction of the closure cap is applied to the security band when the closure cap is rotated in the opening direction.

The present invention further relates to a container having a container neck, wherein the container neck defines a container neck axis and comprises a pouring opening and an outer thread for receiving a closure cap having an inner thread, wherein at least one latching element is arranged on the container neck on a side of the outer thread facing away from the pouring opening, wherein the latching element extends outwardly from the container neck, wherein the latching element comprises a first stop surface having a surface normal arranged at least proportionally tangentially to the container neck, such that, in an assembled state of the container and a closure cap, the first stop surface can be brought into engagement with a first stop surface of the closure cap, wherein, by the engagement of the two first stop surfaces, a holding torque acting counter to an opening direction of the closure cap is applied to the first stop surface of the closure cap when the closure cap is rotated in the opening direction.

The present invention further relates to a combination of a cap and a container, wherein the closure cap comprises a lid portion and a cap skirt having an inner thread, and the container comprises a container neck having an outer thread, such that the closure cap can be screwed onto the outer thread of the container neck, wherein the cap skirt defines a closure axis and the container neck defines a container axis, wherein the closure axis and the container neck axis are coextensive in the assembled state of the closure cap and container, wherein a circumferential security band is arranged on an edge of the cap skirt facing away from the lid portion and connected to the cap skirt via multiple tearable bridges, wherein at least one latching element is arranged on the inner side of the security band, wherein at least one further latching element is arranged on the container neck on a side of the outer thread facing away from the pouring opening, wherein the latching element of the closure cap and the latching element of the container neck are configured and arranged such that, in an assembled state of the closure cap and container, a first stop surface of the latching element of the closure cap can be brought into engagement with a first stop surface of the latching element of the container, wherein, by the engagement of the two first stop surfaces, a holding force acting counter to the opening direction of the closure cap is applied to the security band when the closure cap is rotated in the opening direction.

In the following, "above" etc. should always be understood to mean a position indication or direction indication referring to the axial direction, which points in the direction of the lid portion (for the closure cap) or in the direction of the pouring opening (for the container). Accordingly, "below" etc. is to be understood to mean a position indication or direction indication pointing in the precisely opposite axial direction (rotated by 180 degrees). For example, the cap skirt lies above the security band. In the following, "inward" etc. always refers to a position indication or a direction indication that points radially in the direction of the closure axis or container axis, and "outward" etc. always means a position indication or direction indication pointing radially away from the closure axis or container axis.

BACKGROUND

The containers with closure caps in question are widely used in the form of bottles or canisters for liquids, typically in the agricultural or chemical industries, for example for fertilizers, cleaning liquids, etc. Such containers are generally made of plastic and, in combination with corresponding closures, comprise devices that visibly indicate an initial opening of the closure to a consumer.

The closure cap is in the form of a screw cap with a head plate and a cylindrical cap skirt having an inner thread that fits the outer thread of the container neck.

For the indication of the opening of the closure, i.e. the initial detachment of the closure cap from the container neck, it has become an established practice to use so-called security bands—also referred to as TE bands—which are connected to the closure cap, more precisely to the bottom edge of the skirt of the closure cap, so that they tear away from the closure cap in the event of a manipulation attempt or an opening. "TE" stands for "tamper evidence". Thus, it can be prevented that or at least made discernible if a container has been partially or entirely emptied before the regular initial opening and refilled with other, inferior substances that alter the contents of the container and can pose a health or safety risk to the consumer or simply fail to meet the specifications of the original content.

The connection between a security band and the remaining components of the closure cap must break or tear sufficiently easily both during manipulation attempts as well as during regular opening, in order to not make opening by hand unnecessarily difficult. At the same time, however, the security band must also be sufficiently firmly connected to the remaining components of the closure cap so that the connection is not already damaged or partially broken off when the closure cap is attached to the container neck.

For this purpose, the security band is connected to the cap skirt of the closure cap, for example, via a weakened, thin-walled wall portion or via multiple easily tearable bridges.

In order to ensure that the security band is inevitably separated in the event of an initial opening, the security band has latching elements on its inner side, e.g. latching teeth, which are configured so as to engage with correspondingly configured latching elements on the container neck, e.g. the teeth of a toothed ring arranged on the container neck, upon and after the closing of a container, preventing a rotation of the security band in the opening direction. Often, the latching elements of the closure cap also together form a toothed ring, so that two toothed rings face each other when the closure cap is connected to the container neck.

The teeth of the toothed ring of the container neck are generally additionally designed such that the latching teeth of the security band can slide in the closing direction over the tips of the teeth of the toothed ring without the security band completely or partially tearing away from the closure cap. Only when the closure cap is rotated in the opening direction do the teeth of the toothed ring of the container neck engage with the latching teeth of the security band, such that they prevent the security band from rotating along with the remaining components of the closure cap. The security band then completely tears away from the cap skirt as a result of the opening process.

In such container necks, the tips of the teeth of the toothed ring define a maximum radius of the toothed ring, also referred to herein as the "first radius". Preferably, these teeth are arranged such that all or at least most are arranged on the same radius relative to the central axis of the outer thread. Between the teeth there are tooth gaps, whose base is defined by a minimum radius of the toothed ring, also referred to as "second radius," and usually also lies on a common radius relative to the central closure axis defined by the outer thread. The minimum radius of the toothed ring is generally at least as large as the nominal radius of the outer thread on the container neck in order to avoid an interfering engagement between the latching teeth of the security band and the thread on the container neck when attaching the closure cap to a container neck.

The tips of the teeth could also be arranged on partially different radii relative to the central axis. Similarly, not every tooth base between adjacent teeth must have the minimum radius.

After the initial opening operation, the security bands with latching teeth do not have an effective, axially oriented, form-fitting or friction-locking connection to the container neck, because the latching teeth are loosely engaged with the tooth gaps and are only secured against rotation in the opening direction. Any axial retaining rings, as are common and necessary on the container neck for other security bands, such as flex bands, are generally not present on security bands with latching teeth, because they would inhibit the screwing on of a closure cap with the security band onto the container neck. No corresponding shapes, such as undercuts for axially retaining the security band on the toothed ring, can be formed on the latching teeth of the security band, because screw caps with such undercuts cannot be removed from the moulding tool for the screw cap with the security band. On the other hand, security bands with latching teeth offer a high degree of security against tampering, especially in the case of closures having large diameters of between 50 and 80 mm, so that they are often used for large containers, such as canisters.

Thus, when the closure cap is unscrewed from the container neck, the security band loosely encircling the toothed ring can be removed from the container neck or can fall off when the container is tilted accordingly in order to pour out the filling material contained therein (e.g. a liquid). Thus, during a pouring operation, the security band can slip down from the container neck of the container and fall into a further container into which the filling material contained in the container is to be poured. For example, a liquid located in the container could be filled into a mixer or portioning system, wherein a security band accidentally falling into such a container or mixer could result in significant operational disruptions. This dropping of the security band due to gravity is particularly inconvenient when the ring falls into a fluid container connected to a machine, such as a large plant protection sprayer or a hydraulic reservoir on a hydraulically activated machine.

It is indeed contemplated to adjust the security band by correspondingly fine-tuning the inner diameter defined by the latching teeth and the tooth gaps of the security band, such that the latching teeth remain in friction-locking connection with the toothed ring at the container neck over the entire circumference, in order to thereby avoid the dropping of the security band. In practice, however, the dimensions of the toothed ring of a container neck, which is usually made from plastic in a blowing process, vary too greatly for a dropping of the security band to be securely prevented. Also, the inner diameter defined by the latching teeth cannot be reduced too greatly to values below the minimum radius defined above, because this would impede the attachment of the closure cap to the container neck, which can lead to operational disruptions during filling.

SUMMARY

The problem addressed by the present invention is therefore to create a closure cap and a container with a container neck, which largely prevent an unintended detachment of a security band from a container neck, said security band having already become separated from the remaining components of the closure cap.

This problem is solved by a closure cap having a lid portion and a cap skirt, wherein the cap skirt comprises an inner thread and defines a closure axis such that the closure cap can be screwed onto an outer thread of a container neck, wherein a circumferential security band is arranged on an edge of the cap skirt facing away from the lid portion and connected to the cap skirt via multiple tearable bridges, wherein at least one latching element is arranged on the inner side of the security band, wherein the latching element extends inwardly from the security band, wherein the latching element comprises a first stop surface having a surface normal arranged at least proportionally tangentially to the cap skirt, such that, in an assembled state of the closure cap and a container comprising the container neck, the first stop surface can be brought into engagement with a first stop surface of the container neck, wherein, by the engagement of the two first stop surfaces, a holding torque acting counter to an opening direction of the closure cap is applied to the security band when the closure cap is initially rotated in the opening direction. According to the invention, at least one blocking element is arranged on the security band of the closure cap, wherein the blocking element comprises a second stop surface having a surface normal facing at least proportionally in the axial direction, such that, in an assembled state of the closure cap and a container, the second stop surface can be brought into engagement with a second stop surface of the container neck, wherein, by the engagement of the two second stop surfaces, a holding force acting in the axial direction is applied to the security band when the container is tilted for pouring a filling material.

The invention is based on the idea that the blocking element of the closure cap and its interaction with a container neck prevents the security band from becoming detached from the container when the container is tilted. For example, this prevents the security band from falling down when a canister equipped with the security band and having a typical upper opening is tilted by more than 90 degrees from its standing position. The latching elements alone only block a rotational movement of the security band in the opening direction of the closure cap, which either corresponds to the clockwise circumferential direction, or, in most cases, corresponds to the counter-clockwise circumferential direction. The blocking element additionally restricts the mobility of the security band in the axial direction, in particular in the axial direction facing the lid portion from the security band.

In one embodiment of the closure cap according to the invention, the blocking element and the latching element are two separate, preferably spatially separated elements.

In one embodiment of the closure cap according to the invention, the blocking element is a radially inwardly projecting protrusion extending from the security band, wherein the protrusion is preferably formed integrally with the security band, or is a radially outwardly projecting recess of the security band.

In a preferred embodiment, the blocking element is a protrusion projecting radially inwardly from the security band. Such a protrusion can be easily and straightforwardly manufactured in the injection moulding process and represents a good compromise between the desire for minimum use of material, on the one hand, and the desire for reliable securing of the security band in the axial direction prior to detachment, on the other hand.

The blocking element of the closure cap is preferably configured and arranged, that the first screwing or sticking-on (attachment) on or over the container neck is possible elastically and without great force than would be necessary for a closure cap without blocking elements, but at the same time a sufficient holding force is provided by a form-fitting stop of the second stop surface of the blocking element of the closure cap with the second stop surface of the container neck, which prevents the security band from becoming detached when the container is tilted, regardless of the angle at which the container is tilted. Furthermore, in one embodiment, it should not be readily possible for the user to detach the security band from the container neck with pure hand or finger force.

In one embodiment of the closure cap according to the invention, the protrusion configured as a blocking element or the plurality of protrusions configured as blocking elements project radially inwardly by 0.3 to 1 mm, preferably by 0.7 to 0.8 mm, opposite a surface of the security band that is adjacent to the protrusion(s).

In one embodiment of the closure cap according to the invention, the base of the recess (or a plurality of recesses) configured as a blocking element is 0.5 to 1 mm, preferably 0.7 to 0.8 mm, offset radially outward with respect to a surface of the security band adjacent to the respective recess.

The dimensions of the blocking element of the closure cap according to the invention described herein allows for both a simple attachment of the closure cap to the container neck as well as a sufficient securing of the security band against unintended or even intended detachment.

In one embodiment of the closure cap according to the invention, the blocking element is arranged on the side of the latching element facing away from the lid portion. A closure cap having such an arrangement of the blocking elements is particularly simple and inexpensive to manufacture. In addition, the closure cap is most elastically deformable on the side of the latching element facing away from the lid portion due to the geometry of the closure cap, such that the blocking element can be moved away upon initial screwing or sticking onto or over the container neck particularly simply via a blocking element of the container configured as a protrusion, which has a greater outer radius than the inner radius of the blocking element of the closure cap.

In one embodiment of the closure cap according to the invention, at least two, preferably 8 to 16, and particularly preferably 10 to 14, radially inwardly projecting protrusions or radially outwardly projecting recesses are provided as the blocking elements on or in the security band.

In one embodiment of the closure cap according to the invention, a blocking element configured as a protrusion or as a recess extends respectively over a circumferential portion of the security band, which is between 1/36 and 1/24 of the entire circumference of the security band.

In one embodiment of the closure cap according to the invention, the blocking elements are arranged equidistantly in the circumferential direction. This arrangement provides for a homogeneous holding force acting on the security band when a container, having been connected to the security band via the blocking element after the initial opening of the closure cap, is tilted.

In one embodiment of the closure cap according to the invention, the blocking element is a radially inwardly projecting protrusion extending in the circumferential direction over the entire circumference or a radially outwardly projecting recess extending the circumferential direction over the entire circumference. A correspondingly formed protrusion is also referred to as a ring. Such a ring provides a very homogeneous holding force, but is associated with a higher use of material than multiple short protrusions.

In one embodiment of the closure cap according to the invention, the blocking element has a rectangular, trapezoidal, or foot-shaped cross-section in a cross-sectional plane extending in the axial and radial directions. These cross-sections are particularly well-suited for a form-fitting engagement between the second stop surface of the blocking element of the closure cap and the second stop surface of the container neck.

In one embodiment of the closure cap according to the invention, the blocking element is configured as a protrusion or recess, wherein the protrusion or recess comprises at least one rounded edge extending in the circumferential direction, wherein the rounded edge preferably has a curvature radius of 0.6 mm to 1.5 mm Because the security band and the blocking element of the closure cap must be deformed as elastically as possible when attaching the closure cap to a container, so that the two second stop surfaces can engage, the rounded edges described above are advantageous, because they are associated with a balanced distribution of the forces during a deformation and thus prevent cracks and fractures when attaching the closure cap.

In one embodiment of the closure cap according to the invention, the blocking element, on its side facing away from the lid portion, or alternatively an additional lead-in element arranged on the side of the blocking element facing away from the lid portion, on its side facing away from the lid portion, comprises a lead-in slope having a surface normal, wherein the surface normal of the lead-in slope guides away from the lid portion in the axial direction and is aligned radially inwardly, wherein the lead-in slope is able to cause a uniform deformation of the security band when the closure cap is initially attached to a container. The lead-in slope advantageously causes a uniform deformation of the security band and the blocking element arranged thereon when attaching the closure cap to a container neck when the blocking element of the closure cap has a minimum inner radius that is smaller than the maximum outer radius of the blocking element of the container, such that the latter must be overcome by elastic deformation when attaching the former.

In one embodiment of the closure cap according to the invention, the lead-in slope extends radially inward from a starting inner radius, wherein the starting inner radius is greater than or equal to the maximum outer radius of a blocking element of a container neck that is provided in order to be connected to the closure cap.

The underlying problem of the invention is further solved by a container having a container neck, wherein the container neck defines a container neck axis and comprises a pouring opening and an outer thread for receiving a closure cap having an inner thread, wherein at least one latching element is arranged on the container neck on a side of the outer thread facing away from the pouring opening, wherein the latching element extends outwardly from the container neck, wherein the latching element comprises a first stop surface having a surface normal arranged at least proportionally tangentially to the container neck, such that, in an assembled state of the container and a closure cap, the first stop surface can be brought into engagement with a first stop surface of the closure cap, wherein, by the engagement of the two first stop surfaces, a holding torque acting counter to an opening direction of the closure cap is applied to the first stop surface of the closure cap when the closure cap is initially rotated in the opening direction. According to the invention, a blocking element is arranged on the container neck of the container, wherein the blocking element comprises a second stop surface having a surface normal facing at least proportionally in the axial direction, such that, in an assembled state of the container and the closure cap, the second stop surface can be brought into engagement with a second stop surface of the closure cap, wherein, by the engagement of the two second stop surfaces, a holding force acting in the axial direction is applied to the second stop surface of the closure cap when the container is tilted for pouring a filling material.

A container in the sense of the present invention is also to be understood as a preform, in particular preforms that are intended to be further processed by blow moulding.

The container according to the invention opens the possibility of connecting it to a closure cap comprising a security band, so that, when the closure cap is configured accordingly, for example according to one of the aforementioned embodiments of the closure cap according to the invention, a detachment of the security band is securely prevented when the container according to the invention is tilted during proper use.

In one embodiment of the container according to the invention, the blocking element and the latching element are two separate, preferably spatially separated elements.

In one embodiment of the container according to the invention, the blocking element is a protrusion projecting radially outward from the container neck or a radially inwardly projecting recess of the container neck. Such a protrusion can also be easily and straightforwardly produced in the injection moulding process in the case of a container, in particular a preform, and here, too, represents a good compromise between the desire for minimum material use, on the one hand, and the desire for a reliable tamper-proof function of a security band of a closure cap that is used in order to seal the container.

In one embodiment of the container according to the invention, the protrusion formed as a blocking element or the protrusions formed as multiple blocking elements project radially outwardly above the surface of the container neck adjacent to the protrusion(s) by 0.3 to 1 mm, preferably 0.7 to 0.8 mm.

In one embodiment of the container according to the invention, the base of the recess(es) configured as a blocking element is offset radially inwardly with respect to the surface of the container neck adjacent the respective recess by 0.5 to 1 mm, preferably 0.7 to 0.8 mm.

The dimensions of the blocking element of the container neck according to the invention described herein correspond to the dimensions of the blocking element of the closure cap according to the invention described above. Similarly, the dimensions described herein also allow for a simple attachment of the closure cap onto the container neck as well as a sufficient securing of the security band against unintended or even intended detachment.

In one embodiment of the container according to the invention, the blocking element is arranged on the side of the latching element facing away from the pouring opening. This allows for a corresponding closure cap to be used, in which case the blocking element is arranged on a side facing away from the lid portion of the closure cap, which is associated with the advantages described above for this case.

In one embodiment of the container according to the invention, at least two, preferably 8 to 16, and particularly preferably 10 to 14, radially outwardly projecting protrusions or radially inwardly projecting recesses are provided as the blocking elements on the container neck.

In one embodiment of the container according to the invention, a blocking element configured as a protrusion or as a recess extends respectively over a circumferential portion of the container neck that is between 1/36 and 1/24 of the entire circumference of the portion of the container neck adjacent to the protrusion.

In one embodiment of the container according to the invention, the blocking elements are arranged equidistantly in the circumferential direction. This arrangement provides for a holding force acting homogeneously on a security band of the closure cap when the container, having been connected to the security band after the initial opening of the closure cap via the blocking element, is tilted.

In one embodiment of the container according to the invention, the blocking element is a radially outwardly projecting protrusion extending in the circumferential direction over the entire circumference or a radially inwardly projecting recess extending the circumferential direction over the entire circumference. A correspondingly formed protrusion is also referred to as a ring. Such a ring provides a very homogeneous holding force, but is associated with a higher use of material than multiple short protrusions.

In one embodiment of the container according to the invention, the blocking element has a rectangular, trapezoidal, or foot-shaped cross-section in a cross-sectional plane extending in the axial and radial directions. These cross-sections are particularly well-suited for form-fitting engagement between the second stop surface of the blocking element of the closure cap and the second stop surface of the closure cap.

In one embodiment of the container according to the invention, on its side closest to the pouring opening, the blocking element comprises a lead-in slope having a surface normal, wherein the surface normal of the lead-in slope guides towards the pouring opening in the axial direction and is aligned radially outwardly, wherein the lead-in slope is able to cause a uniform deformation of the security band when the closure cap is initially attached to a security band.

In one embodiment of the container according to the present invention, the lead-in slope of the container extends radially outward in a radial direction from a starting outer radius, wherein the starting outer radius is less than or equal to the value of a minimum inner radius of a blocking element of a closure cap that is provided in order to be connected to the container.

The underlying problem of the invention is further solved by a combination of a cap and a container, wherein the closure cap comprises a lid portion and a cap skirt having an inner thread, and the container comprises a container neck having an outer thread, such that the closure cap can be screwed onto the outer thread of the container neck, wherein the cap skirt defines a closure axis and the container neck defines a container axis, wherein the closure axis and the container neck axis are coextensive in the assembled state of the closure cap and container, wherein a circumferential security band is arranged on an edge of the cap skirt facing away from the lid portion and connected to the cap skirt via multiple tearable bridges, wherein at least one latching element is arranged on the inner side of the security band, wherein at least one further latching element is arranged on the container neck on a side of the outer thread facing away from the pouring opening, wherein the latching element of the closure cap and the latching element of the container neck are configured and arranged such that, in an assembled state of the closure cap and container, a first stop surface of the latching element of the closure cap can be brought into engagement with a first stop surface of the latching element of the container, wherein, by the engagement of the two first stop surfaces, a holding force acting counter to the opening direction of the closure cap is applied to the security band when the closure cap is initially rotated in the opening direction. According to the invention, a blocking element is arranged on the security band of the closure cap and a blocking element is arranged on the container neck, wherein the blocking element of the closure cap and the blocking element of the container are configured and arranged such that, in an assembled state of the closure cap and container, a second stop surface of the blocking element of the closure cap can be brought into engagement with a second stop surface of the blocking element arranged on the container neck, wherein, by the engagement of the two second stop surfaces, a holding force acting in the direction of the closure axis and container neck axis is applied to the security band when the container is tilted for pouring a filling material.

BRIEF DESCRIPTION OF THE FIGURES

Further embodiments, features, and advantages of the present invention are described with reference to the following figures. The figures show.

DETAILED DESCRIPTION

Figure 1:
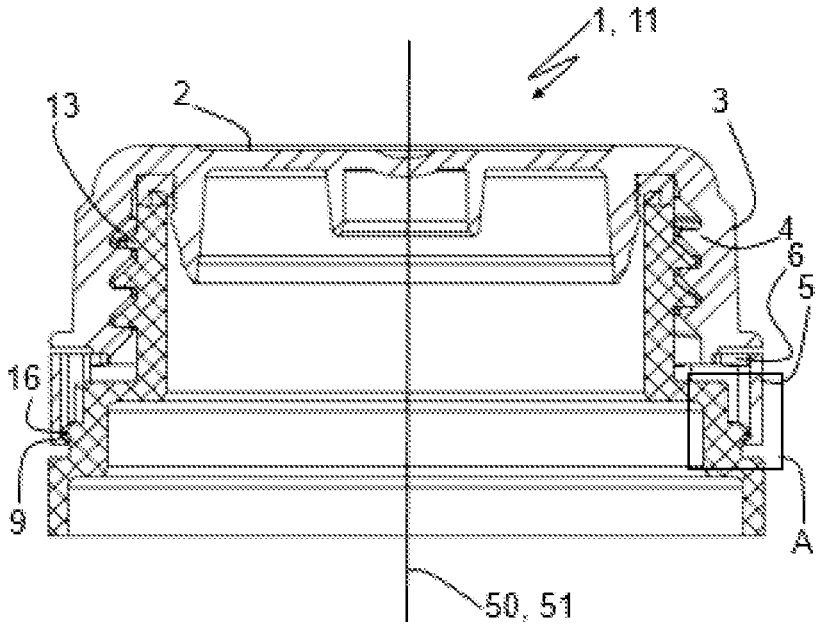
FIG. 1: a cut-away view of an embodiment of the combination of closure cap and container according to the invention along a cutting plane containing the closure axis/container axis, wherein only the container neck is shown.
Figure 2:
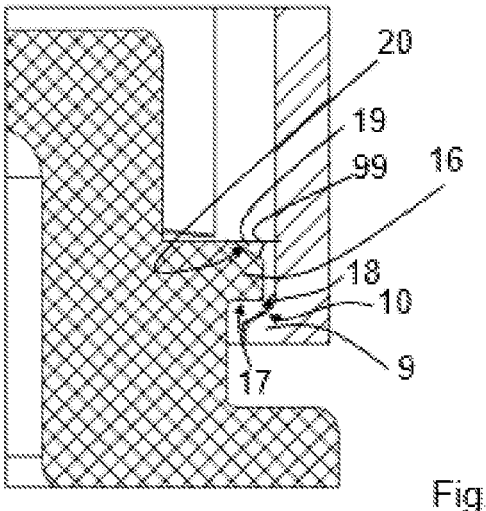
FIG. 2: an enlarged view of region A of FIG. 1, FIG. 3: a perspective view of obliquely below the closure cap from FIG. 1, FIG. 4: a side view of the closure cap from FIG. 1.

The principle of the invention is clearly illustrated by way of FIGS. 1 and 2. In FIG. 1, a cut through an embodiment of the combination of closure cap 1 and container 11 according to the invention is shown, with only the region of the container neck being visible. Taken by themselves, the closure cap 1 shown in FIG. 1 also represents an embodiment of the closure cap according to the invention and the container 11 shown in sections in FIG. 1 represents an embodiment of the container according to the invention. The closure cap 1 is screwed fully onto the container neck in the view shown here, without the closure being opened initially. This therefore represents the situation as encountered by a user before the initial opening of the closure. In particular, the tearable bridges 6 between the cap skirt 3 and the security band 5 are not yet torn.

Based on FIG. 1, it can already be seen that the security band 5 has a respective protrusion that projects radially inwardly at the lower edge, i.e. on the side of the security band 5 facing away from the lid portion 2 at both visible cut positions. This protrusion represents a blocking element 9 arranged on the security band in the sense of the present invention. The mode of action of this blocking element 9 becomes particularly clear based on the following description of FIG. 2.

FIG. 2 shows an enlargement of the region A of FIG. 1 and thus a detail view of the region around a blocking element 9 of the closure cap 1. The blocking element 9 of the closure cap 1 shown here has a foot-shaped cross-section, is arranged at the lowest edge of the security band 5, and thus also below the latching elements 7 of the closure cap 1, and projects radially inwardly by approximately ⅔ of the radial thickness of the security band 5 over the inside of the security band 5. The second stop surface 10 of the blocking element 9 has a slope in the downward axial direction, i.e. in the axial direction facing the lid portion 2 towards the container 11, and rounded edges, resulting in an overall S-curved and simultaneously downwardly inclined second stop surface 10.

A protrusion disposed on the container neck lies opposite the blocking element 9 arranged on the security band 5 in the axial direction on the side of the container 11. This represents a blocking element 16 of the container 11. The blocking element 16 of the container 11 shown here has a trapezoidal cross-section, wherein the second stop surface 17 of the blocking element 16 of the container 11 is arranged on the side of the blocking element 16 facing away from the pouring opening 12 and running substantially perpendicular to the outside of the container neck. The surface portion 20 of the blocking element 16 on the axially opposite side of the blocking element 16 to the second stop surface 17 has a slope directed outwardly and downwardly (leading away from the pouring opening 12), namely with a slope angle of approximately 30 degrees—measured with respect to a plane standing perpendicular to the container axis, which is represented in FIG. 2 by reference line 99—, wherein the slope begins at an outer radius of the container neck, which is smaller than the minimum inner radius of the blocking element 9 of the closure cap 1.

The curved and inclined shape of the second stop surface 10 of the blocking element 9 of the closure cap 1 and the top surface portion 20 of the blocking element 16 of the container 11, inclined downward and outward, upon the initial attachment (screwing on or inverting) of the closure cap 1 onto the container neck, act such that the blocking element 9 is guided on the inclined surface portion 20 like on a sliding track, and thus a continuously increasing and not a sudden deformation of the blocking element 9 of the closure cap 1 and the associated security band 5 occurs radially outwardly. The surface portion 20 thus constitutes a lead-in slope in the sense of the present invention. The rounded edges of the blocking element 9 cause the shear forces occurring upon the deformation to be distributed as evenly as possible to the regions of the blocking element 9 and the security band 5, so that the risk of the occurrence of unintended cracks and fractures due to the deformation during the initial attachment of the closure cap is minimized to the extent possible. This is because the goal in this case is elastic deformation.

In the position of the closure cap 1 and the container 11 shown here, there is a gap 18 between the two second stop surfaces 10 and 17. When the combination 1, 11 shown in FIGS. 1 and 2 is rotated 180 degrees from the position shown, after the closure cap 1 has been initially unscrewed from the container neck 11, the two second stop surfaces 10 and 17 are engaged, thereby preventing the security band 5 from being detached from the container neck. This is the basic principle of the present invention.

Figure 3:
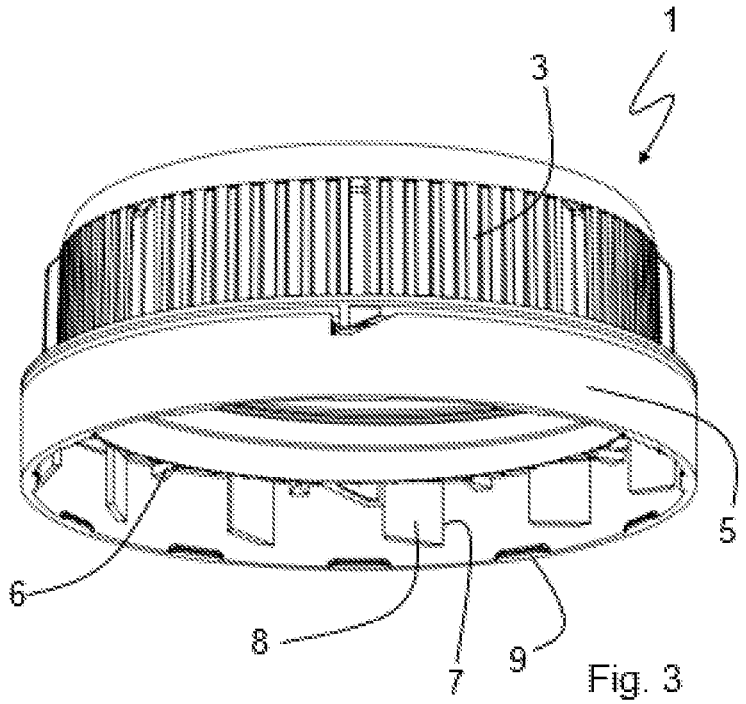

In FIG. 3, the closure cap 1 is shown separately again in a perspective view from obliquely below. In this view, it can be seen that twelve blocking elements 9 are provided distributed equidistantly over the circumference of the security band 5, each of which extends over a distance of 1/30 of the entire circumference of the security band 5. Twelve latching elements 7 are also equidistantly arranged on the security band 5 above the blocking elements 9. This series of latching elements 7 is also referred to as a toothed ring.

Figure 4:
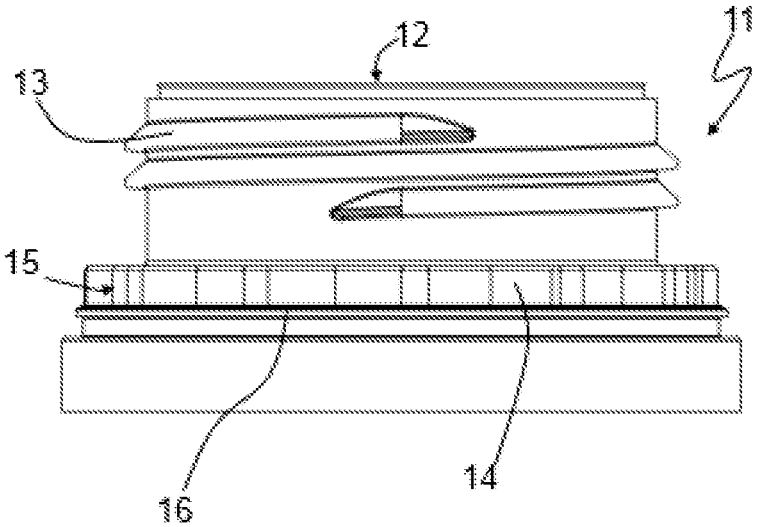

FIG. 4 shows the container neck corresponding to the closure cap 1 of FIG. 3. The blocking element 16 of the container 11 is configured as a circumferential ring so that it is guaranteed for any rotational position that the blocking elements 9 of the closure cap 1 can be brought into engagement with the blocking element 16 of the container neck. A toothed ring having latching elements 7 and corresponding first stop surfaces 15 lying above the blocking element 16 can also be seen in FIG. 4. These first stop surfaces 15 enter into the first stop surfaces 8 of the latching elements 7 of the closure cap 1 upon the initial unscrewing of the closure cap 1 from the container neck in the opening direction in order to block a rotational movement of the security band 5 and thus cause a breakage of the tearable bridges 6 and a detachment of the security band 5 from the remaining components of the closure cap 1.

LIST OF REFERENCE NUMBERS

1 Closure cap
2 Lid portion
3 Cap skirt
4 Inner thread
5 Security band
6 Tearable bridges
7 Latching element of the closure cap
8 First stop surface (of the latching element of the closure cap)
9 Blockade element of the security band (of the closure cap)
10 Second stop surface (of the blocking element of the closure cap)
11 Container (container neck)
12 Pouring opening
13 Outer thread
14 Latching element of the container neck
15 First stop surface (of the latching element of the container neck)
16 Blockade element of the container neck (of the container)
17 Second stop surface (of the blocking element of the container neck)
18 Interstice
19 Angle
20 Surface portion/lead-in slope
50 Closure axis
51 Container axis
99 Reference line for representing an angle
A Enlargement window

The invention claimed is:

1. A closure cap, comprising:
a lid portion and a cap skirt,
wherein the cap skirt comprises an inner thread and defines a closure axis such that the closure cap can be screwed onto an outer thread of a container neck,
wherein a single piece circumferential security band is arranged on an edge of the cap skirt facing away from the lid portion and connected to the cap skirt via multiple tearable bridges,
wherein at least one latching element is arranged on the inner side of the security band,
wherein the at least one latching element extends inwardly from the security band,
wherein the at least one latching element comprises a first stop surface having a surface normal arranged at least proportionally tangentially to the cap skirt, such that, in an assembled state of the closure cap and a container comprising the container neck, the first stop surface can be brought into engagement with a first stop surface of the container neck,
wherein, by the engagement of the two first stop surfaces, a holding torque acting counter to an opening direction of the closure cap is applied to the security band when the closure cap is initially rotated in the opening direction,
wherein a blocking element is arranged on the security band,
wherein the blocking element comprises a second stop surface having a surface normal facing at least proportionally in the axial direction, such that, in an assembled state of the closure cap and a container, the second stop surface can be brought into engagement with a second stop surface of the container neck,
wherein, by the engagement of the two second stop surfaces, a holding force acting in the axial direction is applied to the security band and the at least one latching element when the container is tilted for pouring a filling material.

2. The closure cap according to claim 1, wherein the blocking element is a radially inwardly projecting protrusion extending from the security band, wherein the protrusion is preferably formed integrally with the security band, or is a radially outwardly projecting recess of the security band.

3. The closure cap according to claim 1, wherein the blocking element is arranged on a side of the security band facing away from the lid portion when viewed from the at least one latching element.

4. The closure cap according to claim 1, wherein at least two radially inwardly projecting protrusions or radially outwardly projecting recesses are provided as the blocking elements on the security band.

5. The closure cap according to claim 1, wherein the blocking element is a radially inwardly projecting protrusion extending in the circumferential direction over the entire circumference or a radially outwardly projecting recess extending the circumferential direction over the entire circumference.

6. The closure cap according to claim 1, wherein the blocking element is configured as a protrusion or recess, wherein the protrusion or recess comprises at least one rounded edge extending in the circumferential direction, wherein the rounded edge preferably has a curvature radius of 0.6 mm to 1.2 mm.

7. The closure cap according to claim 1, wherein the blocking element, on its side facing away from the lid portion or an additional lead-in element arranged on the side of the blocking element facing away from the lid portion on its side facing away from the lid portion comprises a lead-in slope having a surface normal, wherein the surface normal of the lead-in slope guides away from the lid portion in the axial direction and is aligned radially inwardly, wherein the lead-in slope is able to cause a deformation of the security band when the closure cap is initially attached to a container.

8. A container having a container neck, A combination of a closure cap and a container, wherein the closure cap comprises a lid portion and a cap skirt having an inner thread and the container comprises a container neck having an outer thread, such that the closure cap can be screwed onto the outer thread of the container neck, wherein the cap skirt defines a closure axis and the container neck defines a container axis, wherein the closure axis and the container neck axis are coextensive in the assembled state of the closure cap and container, wherein a single piece circumferential security band is arranged on an edge of the cap skirt facing away from the lid portion and connected to the cap skirt via multiple tearable bridges, wherein at least one latching element is arranged on the inner side of the security band, wherein the at least one latching element further is arranged on the container neck on a side of the outer thread facing away from the pouring opening, wherein the at least one latching element of the closure cap and the at least one latching element of the container neck are configured and arranged such that, in an assembled state of the closure cap and container, a first stop surface of the at least one latching element of the closure cap can be brought into engagement with a first stop surface of the at least one latching element of the container, wherein, by the engagement of the two first stop surfaces, a holding force acting counter to the opening direction of the closure cap is applied to the security band when the closure cap is initially rotated in the opening direction, wherein a blocking element is arranged on the security band and a blocking element is arranged on the container neck, wherein the blocking element comprises of the closure cap and the blocking element of the container are configured and arranged such that, in an assembled state of the closure cap and container, a second stop surface of the blocking element of the closure cap can be brought into engagement with a second stop surface of the blocking element arranged on the container neck, wherein, by the engagement of the two second stop surfaces, a holding force acting in the direction of the closure and container neck axis is applied to the security band and the at least one latching element when the container is tilted for pouring a filling material.

9. The combination according to claim 8, wherein the blocking element of the container neck is a protrusion projecting radially outwardly from the container neck or is a radially inwardly projecting recess of the container neck.

10. The combination according to claim 8, wherein the blocking element of the container neck is arranged on the side of the container neck facing away from the pouring opening when viewed from the at least one latching element.

11. The combination according to claim 8, wherein at least two radially outwardly projecting protrusions or radially inwardly projecting recesses are provided as the blocking elements on the container neck.

12. The combination according to claim 11, wherein the blocking elements of the container neck are arranged equidistantly in the circumferential direction.

13. The combination according to claim 8, wherein the blocking element of the container neck is a radially outwardly projecting protrusion extending in the circumferential direction over the entire circumference or a radially inwardly projecting recess extending the circumferential direction over the entire circumference.

14. The combination according to claim 8, wherein, on its side closest to the pouring opening, the blocking element of the container neck comprises a lead-in slope having a surface normal, wherein the surface normal of the lead-in slope guides towards the pouring opening in the axial direction and is aligned radially outwardly, wherein the lead-in slope is able to cause a deformation of the security band when the closure cap with a security band is initially attached to the container.

* * * * *